US007172401B2

(12) United States Patent
Kirchhoff

(10) Patent No.: US 7,172,401 B2
(45) Date of Patent: Feb. 6, 2007

(54) SPINNERET FOR MELT SPINNING FILAMENTS

(75) Inventor: Bernd Kirchhoff, Neumünster (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 254 days.

(21) Appl. No.: 10/812,123

(22) Filed: Mar. 29, 2004

(65) Prior Publication Data

US 2004/0228939 A1 Nov. 18, 2004

Related U.S. Application Data

(63) Continuation of application No. PCT/EP02/10565, filed on Sep. 20, 2002.

(30) Foreign Application Priority Data

Sep. 28, 2001 (DE) ..... 101 48 191

(51) Int. Cl.
*B29C 47/30* (2006.01)

(52) U.S. Cl. ..... 425/192 S; 425/382.2; 425/464

(58) Field of Classification Search ..... 425/192 S, 425/382.2, 464
See application file for complete search history.

(56) References Cited

U.S. PATENT DOCUMENTS 3,500,499 A * 3/1970 Goossens ..... 425/192 R
3,762,854 A * 10/1973 Kilsdonk ..... 425/382.2
3,891,379 A * 6/1975 Lenk ..... 425/464
4,645,444 A * 2/1987 Lenk et al. ..... 425/192 S
5,304,052 A * 4/1994 Schroeder et al. ..... 425/192 S
5,507,498 A * 4/1996 Trott ..... 277/300
5,662,947 A * 9/1997 Kretzschmar et al. ... 425/192 S
6,860,732 B2 * 3/2005 Babin et al. ..... 425/549

FOREIGN PATENT DOCUMENTS

| | | |
|---|---|---|
| DE | 1 660 375 A | 4/1972 |
| DE | 125 421 A | 4/1977 |
| DE | 199 32 852 A1 | 1/2001 |
| DE | 199 35 982 A1 | 2/2001 |
| WO | WO 01/09413 A1 | 2/2001 |

* cited by examiner

*Primary Examiner*—Joseph S. Del Sole
(74) *Attorney, Agent, or Firm*—Alston & Bird LLP

(57) ABSTRACT

A spinneret assembly for melt spinning a plurality of strand-like filaments, which includes a plurality of internal parts composed of at least one inlet component 2 and a spinneret plate 3 which are braced relative each other in a housing 1 by a supporting means. The inlet component 2 forms a melt inlet 5, and the spinneret plate 3 forms a melt outlet by means of a plurality of spin holes 4. To achieve during operation a self-sealing between the internal parts, the invention provides for arranging an expansion body 8 between the housing 1 and one of the internal parts. The expansion body 8 is formed of a material which has a higher thermal expansion coefficient than the housing material, and it generates, upon being heated, a pressure force inside the housing which provides for a self-sealing bracing of the internal parts.

16 Claims, 4 Drawing Sheets

SPINNERET FOR MELT SPINNING FILAMENTS

CROSS REFERENCE TO RELATED APPLICATION

The present application is a continuation of international application PCT/EP02/10565, filed 20 Sep. 2002, and which designates the U.S. The disclosure of the referenced application is incorporated herein by reference.

BACKGROUND OF THE INVENTION

The present invention relates to a spinneret for melt spinning a plurality of strand-like filaments, of the general type disclosed, for example, in DE 199 32 852 A1.

A known spinneret of this type comprises a housing, which is used to accommodate a spinneret plate, an apertured plate, a filter insert, as well as an inlet component. The spinneret plate, the apertured plate, and the inlet component are inserted into the housing, and held inside the housing by a threaded member. The internal parts of the housing are made of a material, which has a higher coefficient of thermal expansion than the housing material. With that, it is accomplished that in the operating state of the spinneret, which could be, for example, in an area of 300° C., the internal parts expand inside the housing to a greater extent than the housing surrounding the internal parts. This causes a pressure force to develop, which results in sealing the separating lines between the internal parts or between the internal parts and the housing.

However, the known spinneret has the disadvantage that it always requires the use of different materials for making housing components and internal housing parts of the spinneret. Furthermore, the selection of the materials for the internal parts also requires taking into account an adequate strength and resistance to the polymer melt that is to be processed. With that, only materials are considered, which have a small difference in the thermal expansion coefficients. In this respect, the known spinneret is suited only for very high operating temperatures to generate an adequate sealing effect.

DE 199 35 982 A1 likewise discloses a spinneret, wherein a housing accommodates a filter insert and a spinneret plate. In this spinneret, the spinneret plate is held in the housing by way of a threaded connection. Likewise in this instance, the internal parts are made of materials, which have a greater thermal expansion coefficient than the housing. In this respect, the foregoing disadvantages occur in the same way. In addition, the assembled condition requires that the greater thermal expansion of the internal parts relative the housing requires building up both radially active and axially active forces of pressure.

DD 125421 discloses a spinneret, wherein the spinneret plate and an apertured plate are arranged inside a sleeve, which is mounted by a threaded member to the end face of a housing portion that forms the melt inlet. Between the end face of the housing portion and the attached apertured plate and spinneret plate, a seal is arranged within the sleeve that accommodates the internal parts. The sleeve is made of a material which has a higher thermal expansion coefficient relative to the housing component and the threaded member for purposes of achieving during the heating of the sleeve, a deformation of the seal arranged between the parts, and with that a self-sealing effect. This known spinneret has the disadvantage that the internal parts of the spinneret are inserted directly into a housing component that expands to a greater extent. While taking into account the thermal expansion, it is therefore necessary to insert the internal parts with a corresponding play, which has, however, a negative effect on the required accurate fit for sealing the separating lines.

It is an object of the invention to further develop a spinneret of the initially described type in such a manner that the internal parts that are combined with an accurate fit inside a housing, are held in a self-sealing manner substantially independently of their materials.

SUMMARY OF THE INVENTION

The above and other objects and advantages of the invention are achieved by the provision of a spinneret assembly which includes a plurality of internal parts positioned in a housing, with the internal parts including at least one inlet component and a spinneret plate. The inlet component includes an inlet for admitting a melt into the interior of the housing and the spinneret plate includes a plurality of spin holes which serve as a melt outlet from the housing. Also, at least one expansion body is arranged between the housing and one of the internal parts, and the expansion body is formed of a material which has a higher thermal expansion coefficient in comparison with that of the housing material, and which generates, upon being heated, a pressure force inside the housing for bracing the spinneret plate and the inlet component in a self-sealing manner.

The invention distinguishes itself in that both the housing of the spinneret and the internal parts may be made of materials, which exclusively satisfy the requirements of advancing a melt as well as extruding the melt, such as, for example, strength and resistance. The force of pressure necessary for a self-sealing is exclusively effected by the expansion body, upon being heated. The housing and the internal parts as well as the inlet component and the spinneret plate may be made both of an identical material and of different materials.

The spinneret assembly of the invention further comprises a supporting means which is joined to the housing for supporting the internal parts relative to each other in the housing. To ensure that a bias of the internal parts inside the housing, which adjusts by rotation of the supporting means after the assembly, remains unchanged or is operative on the internal parts being sealed, together with the pressure force that is additionally generated by the heating of the expansion body, it is preferred to construct the spinneret of the invention such that the heating permits generating a pressure force that is largely effective in a clamping direction, which is defined by the supporting means. Also, the expansion body is positioned such that upon being heated it applies a force to the internal parts in an expansion direction that is aligned with the clamping direction.

In this process, it is possible to improve the effect of generating a directed pressure force in that the expansion body and/or the material of the expansion body have a structure, which causes the expansion body to expand, when being heated, substantially or primarily in one direction. In the case of an expansion body, this may be realized, for example, by corresponding length/width ratios.

With the use of round spinnerets, wherein the circular spinneret plates are inserted inside a cylindrical housing, it is preferred according to an advantageous further development of the invention to make the expansion body in the form of an expansion ring. In this case, the expansion ring is arranged between a cover of the housing or an integral flange of the housing, and the inlet component.

With the use of rectangular spinnerets, the expansion body may be formed with advantage by a plurality of expansion pieces, which are arranged between the inlet component and a cover of the housing or an integral flange of the housing.

Irrespective of the shape of the expansion body, a preferred further development of the invention proposes to associate the expansion body with a pressure plate, which forms a contact surface toward the housing or the inlet component. With that, a surface load is advantageously generated and, thus, a pressure force that is uniformly effective over the entire length of the separating lines.

To facilitate assembly and disassembly, in particular also with respect to possible cleaning operations, it is possible to join the expansion body permanently to either the housing or the inlet component.

To improve the self-sealing effect, for example, at operating temperatures below 200° C., one may increase the forces of pressure in that according to a particularly advantageous further development of the invention, the housing is made of a material, which has a lower thermal expansion coefficient in comparison with the materials of the internal parts, such as, for example, the inlet component and the spinneret plate. Thus, in addition to the expansion body, the greater expansion of the internal parts inside the housing would generate pressure forces relative the housing.

To accomplish in spinnerets of this type a uniform extrusion of the polymer melt through all spin holes of the spinneret plate, the housing may additionally accommodate a filter insert and an apertured plate between the inlet component and the spinneret plate. In this case, the supporting means holds the inlet component, the filter insert, the apertured plate, and the spinneret plate inside the housing. To increase the sealing effect, it is preferred to insert seals into the separating lines.

In the operation of the spinneret, it is possible to reach during the extrusion of the polymer melt, pressures and temperatures which possibly cause an overload of the internal parts inside the housing, or an overload of the housing parts or the supporting means. According to an advantageous further development of the invention, a spring extends between the housing and one of the internal parts, which serves to protect against fracture. In this connection, a spring travel is adjusted between the internal parts and the housing, so that uncontrolled expansions can be reliably absorbed.

The spinneret of the invention distinguishes itself in particular in that the expansion body has only the function of building a pressure force upon heating. The functions performed by the spinneret for melt spinning filaments are not relevant for the expansion body, so that the selection of the material for the expansion body can be directed solely to the importance of the thermal expansion. Suited to this end are in particular metals and metal alloys, such as, for example, copper. To ensure that even during cleaning operations, a basic strength of the expansion bodies remains intact, it is preferred to use such metals and metal alloys, whose melting temperature is above about 500° C.

However, there also exists the possibility of making the expansion body and its receptacle exchangeable, so that only melt carrying parts enter an oven for cleaning.

BRIEF DESCRIPTION OF THE DRAWINGS

In the following, the invention is described with reference to several embodiments shown in the attached Figures, in which.

DETAILED DESCRIPTION OF THE PREFERRED EMBODIMENTS

Figure 1:
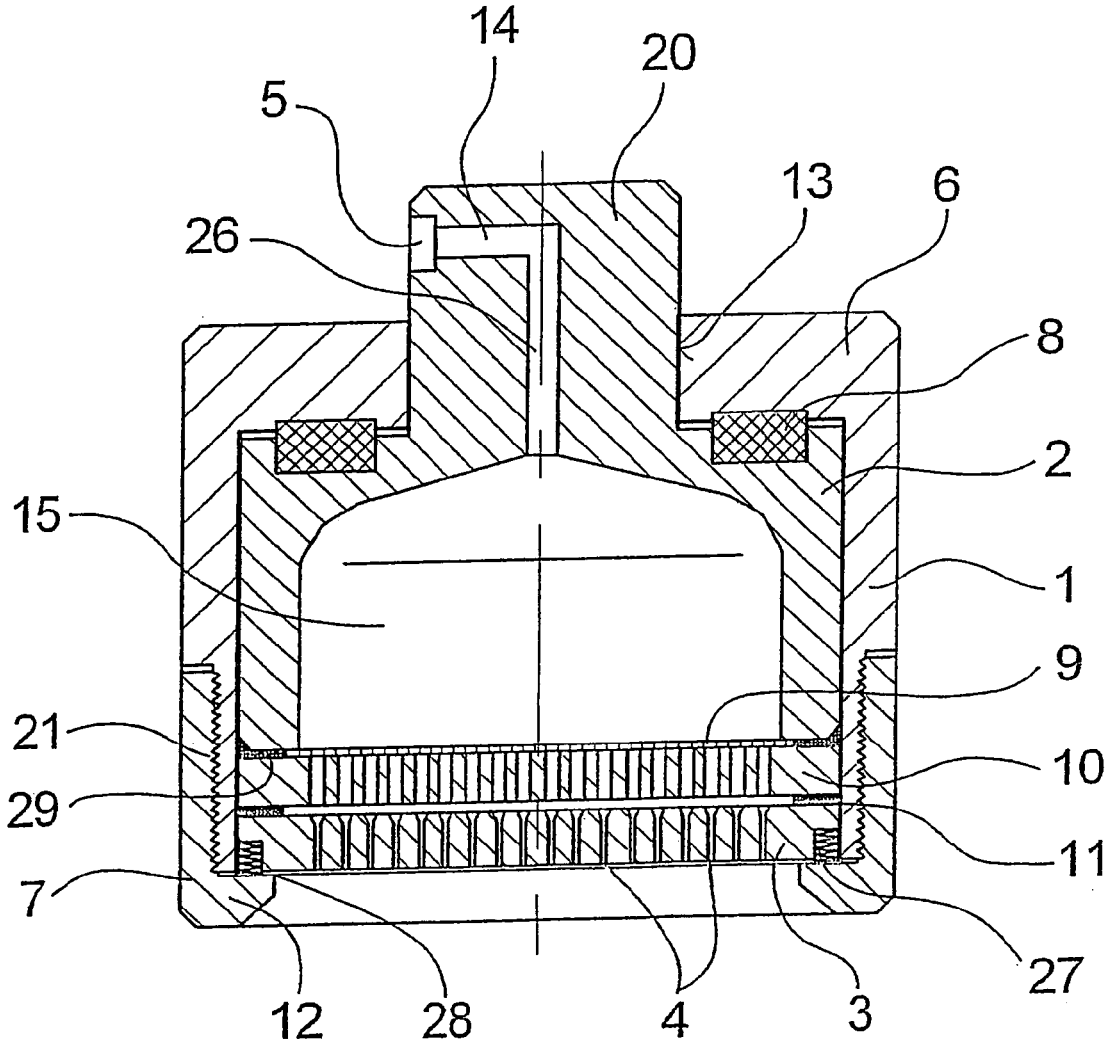
FIG. 1 is a schematic sectional view of a first embodiment of a spinneret assembly according to the invention.

FIG. 1 is a sectional view of a first embodiment of a spinneret according to the invention. The spinneret includes a cylindrical housing 1, which is bounded at an upper side by an integral flange 6. The flange 6 has an opening 13 in its center. Through the opening 13 in the housing flange 6, an extension 20 of an inlet component 2 extends, which is inserted into the housing 1. Between the inlet component 2 and the housing flange 6, an expansion body 8 is arranged which is preferably in the form of an expansion ring.

The inlet component 2 supports itself, via the annular expansion body 8 on the housing flange 6. In its extension 20 outside of the housing 1, the inlet component 2 includes a melt inlet 5, which connects via an inlet channel 14 and a melt channel 26 to a distributor chamber 15 formed inside the inlet component 2. The lower end of inlet component 2 inside the housing 1 engages a filter insert 9, and below the filter insert is an apertured plate 10, and a spinneret plate 3. Between the spinneret plate 3 and the apertured plate 10, an external, circumferential seal 11 is provided. A circumferential seal 29 likewise surrounds the filter insert 9 that is provided in the form of a sieve plate. The seal 29 extends between the apertured plate 10 and the inlet component 2.

The spinneret plate 3 supports itself via a spring insert 27 on a collar 12 of a screw cap 7. Between the underside of the spinneret plate 3 and the collar 12, a gap 28 is formed, which is a measure for the travel of the spring insert 27. The spring insert 27 could be formed by an annular spring or a plurality of springs. The screw cap 7 is constructed as a spigot nut, which engages an external screw thread 21 on the lower end of the housing 1. The spinneret plate 3 is downwardly open, so that spin holes 4 provided within the spinneret plate 3, form a melt outlet.

To assemble the spinneret shown in FIG. 1, one begins with placing the housing 1 with its flange 6 downward into a mounting device. Subsequently, one inserts into the housing 1, one after the other, the annular expansion body 8, the inlet component 2, the filter insert 9, the apertured plate 10, and the spinneret plate 3 with spring insert 27, as well as the associated seals 11 and 29. Finally, one applies the screw cap 7 to the screw thread 21 of the housing 1. In so doing, the internal parts inserted into the housing 1 are supported and biased relative one another.

Before inserting the spinneret into a spin beam, it is first heated in an oven to a temperature between about 200° C. to 250° C. As a result of using different materials and by the action of heat, the expansion body 8, which is made, for example, of copper or a copper alloy, will expand to a greater extent than the housing 1, which is made, for example, of steel. The expansion body 8 primarily expands in a direction toward the apertured plate 10 and spinneret plate 3, so that a pressure force acting in the same direction is generated in addition to the biasing force. As a result, a self-sealing action is realized in the separating lines between the inlet component 2, apertured plate 9, and spinneret plate 3. The use of the seals 11 and 29 in the separating lines of the individual parts ensures an adequate outward sealing even in critical spinning startup phases. The sealing effect is additionally increased, when the melt pressure is fully operative.

During the operation of the spinneret according to the invention, a polymer melt advances through the melt inlet 5 of the spinneret, and enters the distributor chamber 15 through inlet channel 14 and melt channel 26. From the distributor chamber 15, the polymer melt passes through filter insert 9 and apertured plate 10. Subsequently, the polymer melt is extruded through the spin holes 4 of spinneret plate 3 to form a plurality of strand-like filaments. Inside the distributor chamber 15, melt pressures as high as 250 bars are reached. To filter the polymer melt, it is preferred to form the filter insert 9 by one of more sieves with different mesh widths. However, it is also possible to use above the apertured plate 10 a filter insert with filter granules of different grain sizes.

To generate by heating the spinneret pressure forces that are as high as possible, it would be possible to make the internal parts, such as inlet component 2, apertured plate 10, and spinneret plate 3, of a material that has a higher thermal expansion coefficient than the housing 1. Thus, it would be possible to make, for example, the housing of steel, the internal parts of stainless steel, and the expansion body likewise of stainless steel. This procedure has the advantage that the use of a stainless steel ensures resistance of the internal parts to the polymer melt.

In the embodiment shown in FIG. 1, the expansion ring 8 may be permanently joined to the flange 6. This makes it possible to remove and reinstall the melt-carrying parts in a simple manner for cleaning purposes.

In the case that the cleaning process is performed on the assembled spinneret, the material of the expansion body is to be selected such that the high cleaning temperatures of more than 500° C. do not lead to any undesired change of the expansion body. Thus, the material of the expansion body should have at least a melting temperature above 500° C.

To be able to absorb uncontrolled expansions within the housing 1 without any overload, the spring insert 27 extends between the collar 12 of the screw cap 7 and the spinneret plate 3. The gap 28 formed between the underside of the spinneret plate 3 and the collar 12 enables an additional expansion of the internal parts or the expansion body.

Figure 2:
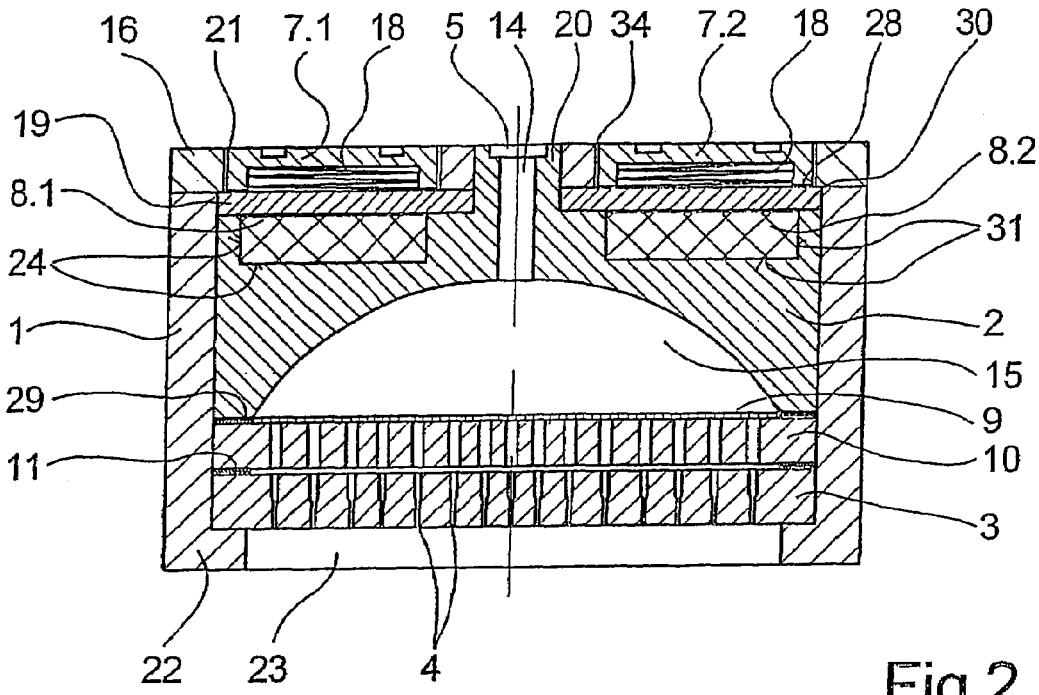
FIG. 2 is a schematic sectional view of a further embodiment of a spinneret assembly according to the invention.
Figure 3:
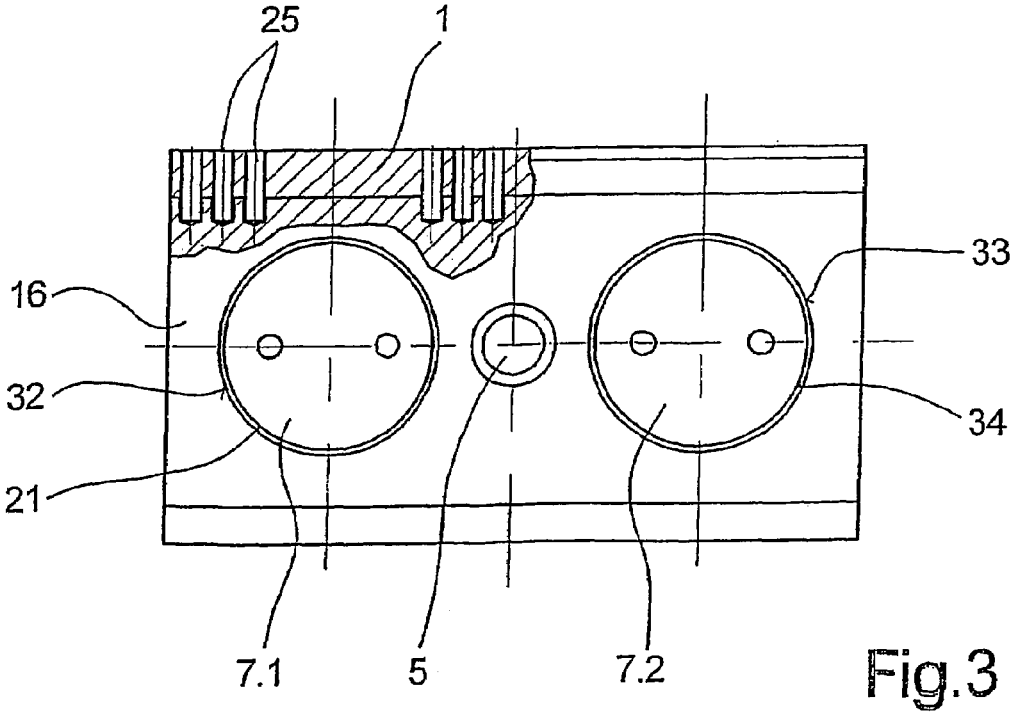
FIG. 3 is a schematic top view of the embodiment of FIG. 2.

FIGS. 2 and 3 show a further embodiment of a spinneret according to the invention, with FIG. 2 being a schematic sectional view of the spinneret, and FIG. 3 a schematic top view thereof. Unless reference is made to one of the Figures, the following description will apply to both Figures. Also, components having the same function are provided with identical reference numerals.

Contrary to the foregoing embodiment, the embodiment shown in FIGS. 2 and 3 is constructed as a rectangular spinneret as best seen in FIG. 3. To this end, the spinneret comprises a rectangular housing 1, which includes on its underside an integral collar 22 with an opening 23 that is needed for extruding the filaments. Arranged on the housing collar 22, inside the housing 1, are a rectangular spinneret plate 3, a seal 11, an apertured plate 10, a filter insert 9 with a seal 29, as well as an inlet component 2. In the center region of housing 1, the inlet component 2 comprises an extension 20, which projects from the housing 1 and forms a melt inlet 5.

To receive the expansion body, which in this embodiment is formed by two expansion pieces 8.1 and 8.2 arranged in a separated relationship, the inlet component 2 includes two adjacent recesses 24 and 31, which accommodate the expansion pieces 8.1 and 8.2. Outside of the inlet component 2, the expansion pieces 8.1 and 8.2 are supported below pressure plates 19 and 30 respectively. Above the pressure plates 19 and 30, the housing 1 is closed by a cover 16. The housing cover 16 is secured by pins 25. Arranged in the housing cover 16 are two adjacent openings 32 and 33 which are internally threaded as indicated at 21 and 34. The screw threads 21 and 34 mesh with screw caps 7.1 and 7.2 respectively, which act directly upon the pressure plates 19 and 30. During the assembly, this allows to achieve a bias of the internal parts that are inserted into the housing 1, with the screw caps 7.1 and 7.2 being uniformly screwed into the screw threads 21 and 34 of the housing cover 16.

The selection of the materials for the expansion pieces, the housing 1, as well as the internal parts, may be realized in accordance with the embodiment of FIG. 1. Likewise, the sequence of the assembly and the heating of the spinneret for generating the forces of pressure correspond to the foregoing embodiment, so that the foregoing description is herewith incorporated by reference.

As shown in FIG. 2, the embodiment of the spinnerets according to the invention includes a safety element for being able to absorb uncontrolled expansions. To this end, a spring 18 extends respectively between the screw cap 7.1 and pressure plate 19 as well as the screw cap 7.2 and the pressure plate 30. Between the screw caps 7.1 and 7.2 and the pressure plates 19 and 30 respectively, a gap 28 is formed, which limits the acceptable travel of the springs 18, and thus enables a maximum expansion of the internal parts.

Figure 4:
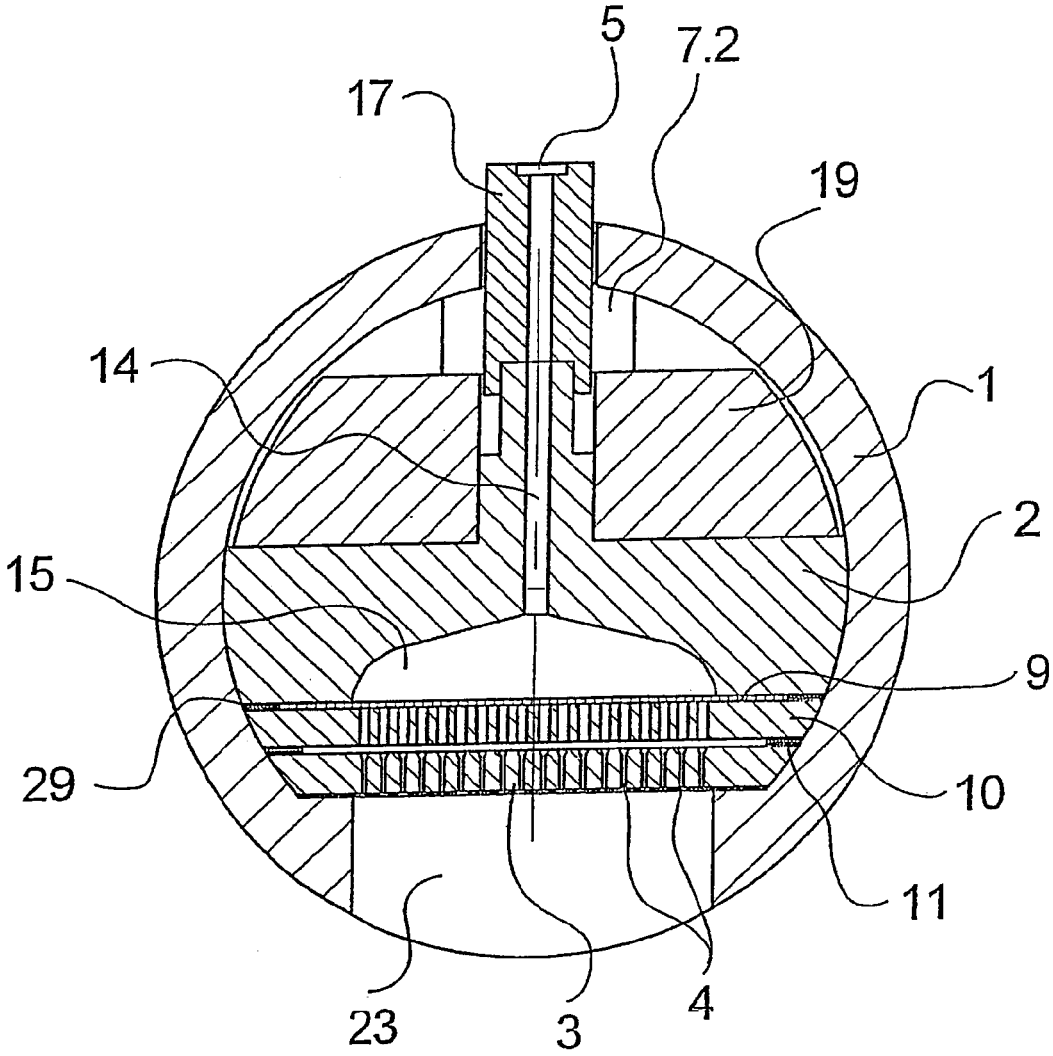
FIGS. 4 and 5 are schematic views of a further embodiment of the spinneret assembly according to the invention.
Figure 5:
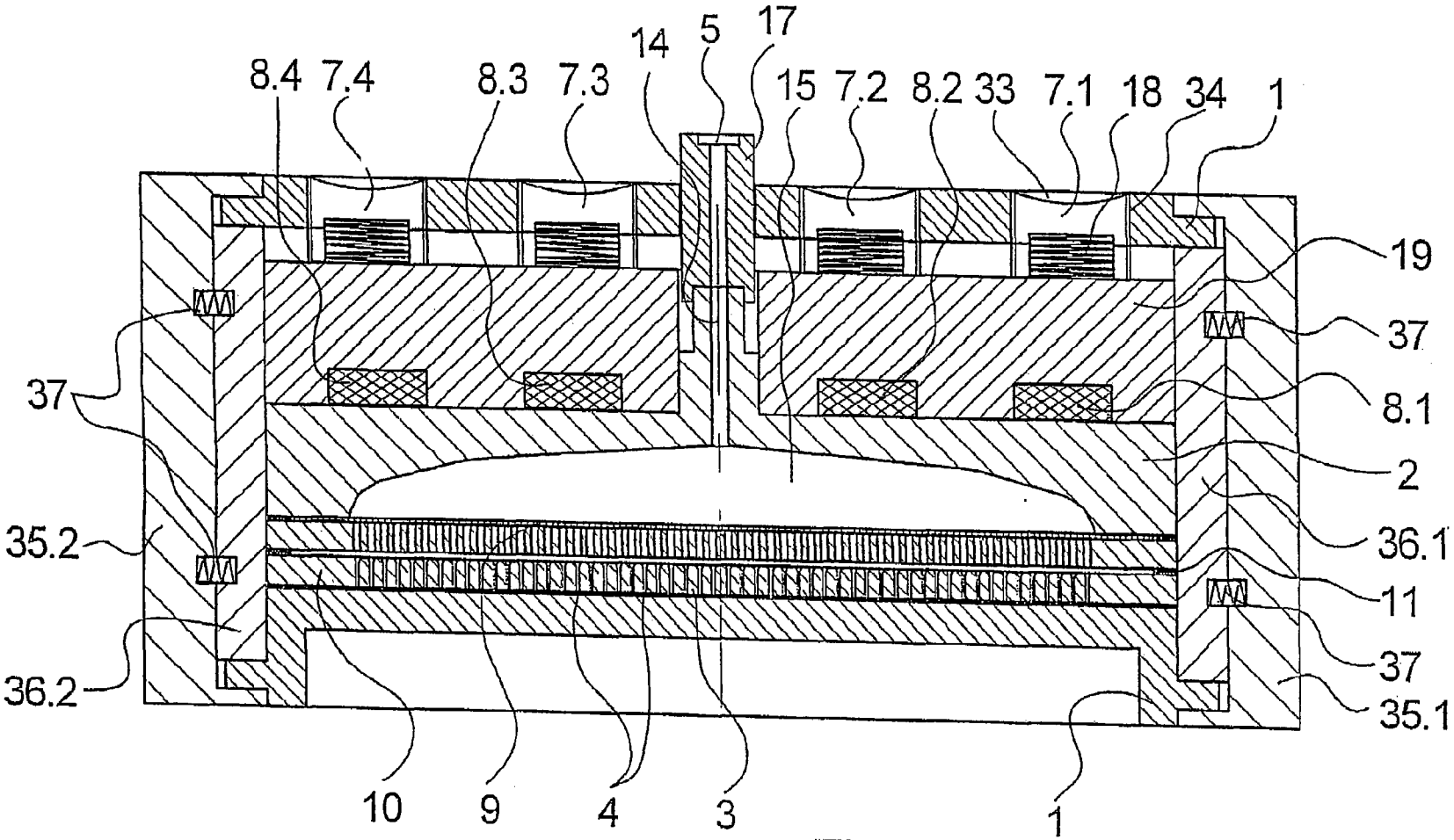

FIGS. 4 and 5 illustrate a further embodiment of a spinneret according to the invention. FIG. 4 is a schematic cross sectional view and FIG. 5 a schematic, longitudinally sectioned view of the embodiment. Unless express reference is made to one of the Figures, the following description will apply to both Figures. For the sake of a better general view, parts of the same function are provided with identical reference numerals.

The embodiment of the spinneret shown in FIGS. 4 and 5 comprises a tubular housing 1. The tubular housing 1 is horizontally oriented so that its central axis is generally perpendicular to the direction of the melt flow through the housing. Also, the housing is closed at each end by an end plate 36.1 and 36.2 and a cover 35.1 and 35.2 respectively. Between the end plates 36.1 and 36.2 and the covers 35.1 and 35.2, a plurality of pressure springs 37 are operative. As best seen in FIG. 4, the housing is formed to include an axially extending internal collar or shoulder which supports the spinneret plate 3 thereupon.

In the housing 1, the spinneret plate 3, apertured plate 10, filter insert 9, inlet component 2, and a pressure plate 19 are superposed between the end plates 36.1 and 36.2. The seal 11 is positioned between the spinneret plate 3 and the apertured plate 10, and the seal 29 is positioned between the apertured plate 10 and the inlet component 2. In this arrangement, the seal 29 surrounds the filter insert 9. The inlet component 2 forms a distributor chamber 15 and connects to an inlet adapter 17, which forms the melt inlet 5 outside of the housing 1, and which forms with the inlet component 2 an inlet channel 14 that terminates in the distributor chamber 15.

On its lower side, the housing 1 includes in the region of the spinneret plate 3, a cutout 23, so that filament strands emerging from the spin holes 4 in the spinneret plate 3 can be extruded unimpeded. On its upper side, the housing 1 includes a plurality of threaded openings 33, which each receive a screw cap 7.1–7.4. The screw caps connect to the housing 1 via a screw thread 34. In this embodiment, a total of four screw caps 7.1–7.4 are provided. Each of the screw caps 7.1–7.4 tensions a spring 18 relative to the pressure plate 19. The opposite underside of the pressure plate 19 mounts a plurality of expansion bodies 8.1–8.4, which are supported between the inlet component 2 and the pressure plate 19.

The function of the embodiment shown in FIGS. 4 and 5 is identical with the foregoing embodiments of the spinneret according to the invention, so that the foregoing description is herewith incorporated by reference. For cleaning the spinneret, only the melt carrying components 2, 3, and 10 are cleaned by heat in a pyrolysis oven at temperatures of about 500° C. The pressure plate 19 with expansion bodies 8.1–8.4 is exchangeable, and therefore need not be subjected to these high cleaning temperatures. This results in a still greater variety of the material selection.

The spinneret of the invention distinguishes itself in that the materials of the individual parts can be selected in accordance with their function. With that, there exists the possibility that each function, such as carrying the melt, building forces of pressure, or maintaining the internal pressure, can be optimally performed in a purposeful manner by a corresponding material selection. In this connection, it is important that the controlled expansion of the used materials permits realizing a self-sealing effect. At room temperature and thus, with little bias of the parts, this effect facilitates a rapid and simple assembly of the spinneret. The imperviousness of the spinneret assembly does not depend on the forces that are applied by tightening the screw caps. Consequently, the spinneret of the invention distinguishes itself by a high reliability in operation.

The construction of the illustrated embodiments of the spinneret according to the invention as well as the construction of the individual components are exemplary. The invention encompasses all spinnerets, wherein an additional expansion body braces the internal parts in a self-sealing manner inside a housing.

The invention claimed is:

1. A spinneret assembly for melt spinning a plurality of strand-like filaments and comprising an external housing, a plurality of internal parts positioned in the housing and including at least one inlet component and a spinneret plate, with the inlet component including a downstream side which defines a distributor chamber within the housing and an inlet for admitting a melt into the distributor chamber in the interior of the housing and with the spinneret plate positioned on the downstream side of the inlet component so as to communicate with the distributor chamber and including a plurality of spin holes which serve as a melt outlet from the housing, means joined to the housing for supporting the internal parts relative to each other in the housing, and at least one expansion body arranged in the housing between the housing and an upstream side of the inlet component, with the expansion body being formed of a material which has a higher thermal expansion coefficient in comparison to that of the housing material, and with the expansion body being positioned such that upon being heated a pressure force is generated which provides a self sealing bracing of the inlet component toward the spinneret plate.

2. The spinneret assembly of claim 1 wherein the supporting means supports the internal components in a clamping direction, and wherein the expansion body is positioned such that upon being heated it applies a force to the internal parts in an expansion direction that is aligned with the clamping direction.

3. The spinneret assembly of claim 2 wherein the expansion body is configured such that upon being heated, it expands primarily in the expansion direction.

4. The spinneret assembly of claim 2 wherein the expansion body is in the form of a ring which is positioned between the inlet component and the housing.

5. The spinneret assembly of claim 2 wherein the expansion body is formed by a plurality of separate expansion pieces which are positioned between the inlet component and the housing.

6. The spinneret assembly of claim 2 further comprising at least one pressure plate positioned in the housing between the expansion body and the housing or between the expansion body and the inlet component.

7. The spinneret assembly of claim 2 further comprising a spring member positioned in the housing between the housing and the spinneret plate or between the housing and the inlet component such that a spring force is operative in the clamping direction and a gap is formed between the housing and the spinneret plate or the inlet component.

8. The spinneret of claim 1 wherein the expansion body is permanently joined to the housing or to one of the internal parts.

9. The spinneret of claim 1 wherein the housing is formed of a material which has a lower thermal expansion coefficient in comparison to the materials of the inlet component and the spinneret plate.

10. The spinneret assembly of claim 1 further comprising a filter insert and an apertured plate positioned in the housing between the inlet component and the spinneret plate and so as to be held in place by the supporting means.

11. The spinneret assembly of claim 1 wherein the expansion body is formed of a material whose melting temperature is above about 500 degrees C.

12. The spinneret assembly of claim 1 wherein the expansion body is positioned in the housing so as to be exchangeable.

13. The spinneret assembly of claim 1 wherein the housing is of generally cylindrical configuration so as to define a central axis which is generally parallel to direction of the melt flow through the housing, with the housing including an integral flange at one end and an external thread at the other end, wherein the supporting means comprises a screw cap which is threadedly joined to the external thread at said other end of the housing and which includes a radial collar, wherein the internal parts are supported between the integral flange of the housing and the radial collar of the screw cap, and wherein the expansion body is arranged between the integral flange of the housing and the upstream side of the inlet component.

14. The spinneret assembly of claim 1 wherein the housing is of generally rectangular configuration and includes opposite ends which are spaced apart in the direction of the melt flow through the housing, said housing including a cover overlying one end thereof and a radial collar at the opposite end, wherein the internal parts are supported between the cover and the radial collar, wherein the at least one expansion body comprises a plurality of expansion bodies arranged in a separated arrangement between the cover and the upstream side of the inlet component, and wherein the supporting means comprises a plurality of screw caps which are disposed in threaded openings which extend through the cover, with the screw caps being positioned to overlie respective ones of the expansion bodies.

15. The spinneret assembly of claim 1 wherein the housing is of generally tubular configuration so as to define a central axis which is generally perpendicular to the direction of the melt flow through the housing, with the housing defining an axially extending internal collar which supports said spinneret plate thereupon, and wherein the supporting means comprises a pressure plate positioned to overlie the at least one expansion body, and a plurality of screw caps which are disposed in threaded openings which extend through the cover and perpendicularly with respect to said central axis and said spinneret plate and so as to engage said pressure plate.

16. The spinneret assembly of claim 14 further comprising a pressure plate interposed between each expansion body and the overlying screw cap.

* * * * *